US008041275B2

(12) United States Patent
Soria et al.

(10) Patent No.: US 8,041,275 B2
(45) Date of Patent: Oct. 18, 2011

(54) RELEASE LAYER

(75) Inventors: Meir Soria, Jerusalem (IL); Nava Klein, Rishon Le Tzion (IL); Amiran Lavon, Bat Yam (IL); Yael Kowal, Tel Aviv (IL); Yevgenia Rudoy, Rishon Lezion (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 361 days.

(21) Appl. No.: 12/262,166

(22) Filed: Oct. 30, 2008

(65) Prior Publication Data

US 2010/0111577 A1 May 6, 2010

(51) Int. Cl.
*G03G 15/01* (2006.01)
*G03G 15/20* (2006.01)

(52) U.S. Cl. ..... 399/302; 399/308

(58) Field of Classification Search ..... 399/302, 399/308

See application file for complete search history.

(56) References Cited

U.S. PATENT DOCUMENTS

| | | | | |
|---|---|---|---|---|
| 5,337,129 | A | 8/1994 | Badesha | |
| 5,537,194 | A * | 7/1996 | Henry et al. | 399/308 |
| 5,576,818 | A | 11/1996 | Badesha et al. | |
| 5,585,905 | A | 12/1996 | Mammino et al. | |
| 5,991,590 | A * | 11/1999 | Chang et al. | 399/302 |
| 6,365,280 | B1 * | 4/2002 | Schlueter et al. | 428/447 |
| 6,551,716 | B1 | 4/2003 | Landa et al. | |
| 7,400,850 | B2 | 7/2008 | Romem | |
| 2002/0064402 | A1 | 5/2002 | Badesha et al. | |

FOREIGN PATENT DOCUMENTS

| | | |
|---|---|---|
| DE | 10117409 | 10/2002 |
| JP | 11231678 | 8/1999 |

* cited by examiner

*Primary Examiner* — David Gray
*Assistant Examiner* — Erika J Villaluna

(57) ABSTRACT

An apparatus and method transfer imaging material using a release layer having a bulk swelling capacity between 120% and 145% in Isopar L.

22 Claims, 2 Drawing Sheets

RELEASE LAYER

BACKGROUND

Imaging systems sometimes employ an intermediate transfer member that transfers layers of imaging material in a liquid carrier to a substrate or print medium. The intermediate transfer member includes a release layer that absorbs some of the liquid carrier and facilitates releasing of the layers of imaging material to the print medium. Existing release layers either do not satisfactorily release layers of imaging material to the substrate or result in undesirable gloss memory on the print, a gloss difference between the image and the background areas transferred onto the substrate.

DETAILED DESCRIPTION OF THE EXAMPLE EMBODIMENTS

Figure 1:
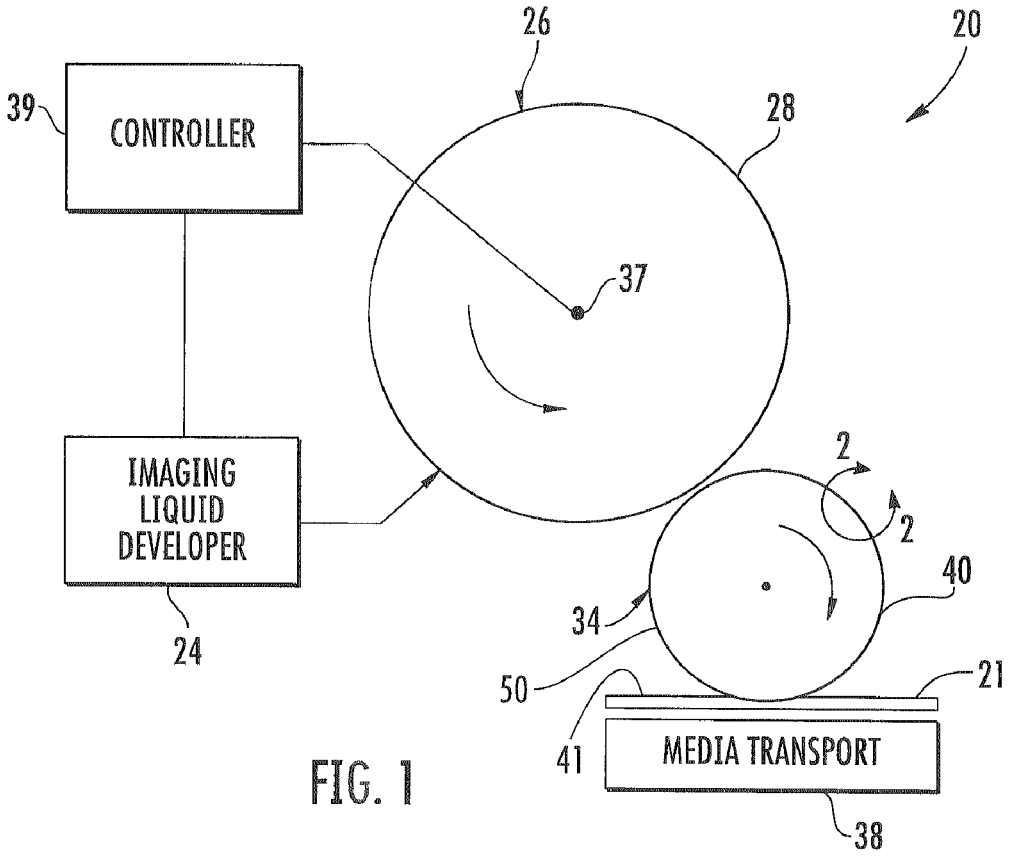
FIG. 1 is a schematic illustration of an imaging system according to an example embodiment.

FIG. 1 schematically illustrates imaging system or printer 20 according to an example embodiment. Printer 20 forms images upon a print medium 21 using an electrostatically charged imaging liquid such as a liquid toner or ink carrying the imaging material. As will be described hereafter, printer 20 includes an intermediate transfer member 34 having an outer release layer 50 that transfers a plurality of layers of imaging material or toner to the substrate or print medium 21. The release layer 50 receives the layers of imaging material and effectively releases and transfers the layers of imaging material to substrate 21 with reduced gloss memory or without gloss memory.

Printer 20 includes imaging liquid developer 24, imaging member 26 having imaging surface 28, intermediate transfer member 34, media transport 38 and controller 39. Imaging liquid developer 24 comprises a mechanism configured to form or develop at least portions of graphic, text or an image on imaging surface 28 by selectively applying imaging liquid, including imaging material, marking materials, monochromatic or chromatic particles or toner, to surface 28. In the example illustrated, developer 24 sequentially applies different layers of the imaging liquid. In other words, developer 24 first applies a first layer of imaging liquid carrying imaging material to imaging surface 28, wherein imaging surface 28 transfers the first layer of imaging liquid to intermediate transfer member 34 prior to developer 24 applying a second different layer of imaging liquid carrying different imaging materials to imaging surface 28.

According to one example embodiment, developer 24 comprises a plurality of rollers, each of the rollers dedicated to selectively applying a different imaging liquid carrying a different imaging material and to forming a different layer of imaging liquid on surface 28. In one embodiment, each roller of developer 24 transfers and applies electrostatically charged imaging liquid to imaging surface 28. The imaging liquid includes a carrier liquid and an ink (also known as colorant particles or toner particles). The carrier liquid comprises an ink carrier oil, such as Isopar L a synthetic iso-paraffin made by Exxon, or other low or medium molecular weight hydrocarbon oil. The carrier liquid may include other additional components such as a high molecular weight oil, such as mineral oil, a lubricating oil and a defoamer. In one embodiment, the liquid carrier liquid and colorant particles or imaging material comprises HEWLETT-PACKARD ELECTRO INK commercially available from Hewlett-Packard. In other embodiments, the imaging liquid may comprise other imaging liquids.

Imaging member 26 comprises a member supporting imaging surface 28. Imaging surface 28 (sometimes referred to as an imaging plate) comprises a surface configured to have one or more electrostatic patterns or images formed thereon and to have electrostatically charged imaging material, part of the imaging liquid, applied thereto. The imaging material adheres to selective portions of imaging surface 28 based upon the electrostatic images on surface 28 to form imaging material images on surface 28. The imaging material images are then subsequently transferred to intermediate transfer member 34.

In the example illustrated, imaging member 26 comprises a drum configured be rotated about axis 37. In other embodiments, imaging member 26 may comprise a belt or other supporting structures. In the example illustrated, surface 28 comprises a photoconductor or photoreceptor configured to be charged and have portions selectively discharged in response to optical radiation such that the charged and discharged areas form the electrostatic images. In other embodiments, surface 28 may be either selectively charged or selectively discharged in other manners. For example, ionic beams or activation of individual pixels along surface 28 using transistors may be used to form electrostatic images on surface 28.

In the embodiment illustrated, imaging surface 28 comprises a photoconductive polymer. In one embodiment, imaging surface 28 has an outermost layer with a composition of a polymer matrix including charge transfer molecules (also known as a photoacid). In on embodiment, the matrix may comprise a polycarbonate matrix including a charge transfer molecule that in response to impingement by light, generates an electrostatic charge that is transferred to the surface. In other embodiments, imaging surface 28 may comprise other photoconductive polymer compositions.

Intermediate transfer member 34 comprises a member configured to receive imaging liquid 40 from imaging surface 28 and to transfer imaging material contained in the imaging liquid onto print medium 21. Intermediate image transfer member 34 has an external release layer 50 that absorbs at least a portion of the liquid carrier of the imaging liquid prior to the imaging material 41 being transferred to print medium 21. As noted above, release layer 50 effectively releases and transfers the layers of imaging material to substrate 21 with reduced gloss memory.

Figure 2:
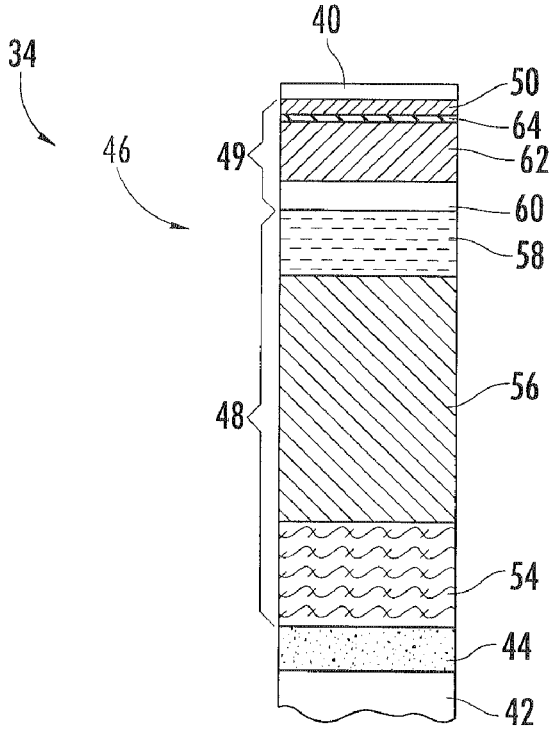
FIG. 2 is enlarged fragmentary sectional view of a portion of an intermediate transfer member of the imaging system of FIG. 1 according to an example embodiment.

FIG. 2 is an enlarged fragmentary view of a portion of intermediate transfer member 34 carrying a plurality of layers of imaging material 41 prior to the release of the layers onto print medium 21. In the example illustrated, intermediate transfer member 34 includes support 42, adhesive layer 44, and blanket 46 including blanket body 48 and image transfer portion 49 which includes release layer 50. Support 42 comprises a structure serving as a foundation for blanket 46. In one embodiment in which image forming portion 46 is heated through support 42, such as with an internal halogen lamp heater or other heater, support 42 may be formed from one more materials having a high degree of thermal conductivity.

In the example illustrated, support 42 comprises a drum. In other embodiments, support 42 may comprise a belt or other supporting structure.

Adhesive layer 44 secures blanket 46 to support 42. Adhesive layer 44 may have a variety of compositions which are compatible with innermost surface of blanket 46 and the outer surface of support 42. In other embodiments, blanket 46 may be secured to support 42 in other manners.

Blanket body 48 of blanket 46 extends between support 42 and image transfer portion 49 of blanket 46. Blanket body 48 comprises one or more layers of materials configured to provide compressibility for blanket 46. In the example illustrated, blanket body 48 includes fabric layer 54, compressible layer 56, and top layer 58. Fabric layer 54 comprises a layer of fabric facilitating the joining of blanket body 48 to support 42. In one embodiment, fabric layer 54 comprises a woven NOMEX material having a thickness of about 200 μm. In embodiments where intermediate image transfer member 34 is externally heated and omits internal heating, fabric layer 54 may be formed from other less heat resistant fabrics or materials.

Compressible layer 56 comprises one or more layers of one or more materials having a relatively large degree of compressibility. In one embodiment, compressible layer 56 comprises 400 μm of saturated nitrile rubber loaded with carbon black to increase its thermal conductivity. In one embodiment, layer 56 includes small voids (about 40 to about 60% by volume).

Top layer 58 serves as an intermediate layer between compressible layer 56 and image transfer portion 49 of blanket 46. According one embodiment, top layer 58 is formed from the same material as compressible layer 56, but omitting voids. In other embodiments, top layer 58 may be formed from what more materials different than that of compressible layer 56.

According to one embodiment, blanket body 48 comprises MCC-1129-02 manufactured and sold by Reeves SpA, Lodi Vecchio, Milano, Italy. In yet another embodiment, blanket body 48 may be composed of a fewer or greater of such layers or layers of different materials.

Image forming portion 49 of blanket 46 comprise the outermost set of layers of blanket 46 which have the largest interaction with the imaging liquid and print medium 21 (shown in FIG. 1). In addition to release layer 50, image forming portion 49 includes conductive layer 60, conforming layer 62 and priming layer 64. Conductive layer 60 overlies blanket body 48 and underlies conforming layer 62. Conductive layer 60 comprises layer one or more conductive materials in electrical contact with an allegedly conducted bar for transmitting electric current to conducting portion 60. Electrical charge supplied to conducting layer 64 results in a transfer voltage proximate the outer surface of transfer portion 49, facilitating transfer of the electrostatically charged imaging material.

In other embodiments, conducting layer 60 may be omitted such as in embodiments where layers beneath conducting layer 60 are partially conducting or wherein conforming layer 62 or release layer 50 are somewhat conductive. For example, conforming layer 56 may be made partially conductive with the addition of conductive carbon black or metal fibers. Adhesive layer 44 may be made conductive such that electric current flows directly from support 42. Conforming layer 62 and/or release layer 50 may be made somewhat conductive (between $10^6$ and $10^{11}$ ohm-cm and nominally between $10^9$ and $10^{11}$ ohm-cm) with the addition of carbon black or the addition of between 1% and 10% of antistatic compounds such as CC42 sold by Witco.

Conforming layer 62 comprises a soft conforming elastomeric layer 50. Conforming layer 62 provides conformation of blanket 46 to image surface 28 (shown in FIG. 1) at the low pressures used in the transfer of images of imaging liquid to blanket 46. In one embodiment, conforming layer 62 comprises a polyurethane or acrylic having a Shore A hardness of less than about 65. In one embodiment, conforming layer 62 has a hardness of less than about 55 and greater than about 35. In other embodiments, conforming layer 62 may have a suitable hardness value of between about 42 and about 45.

Priming layer 64 comprises a layer configure to facilitate bonding or joining of release layer 50 to conforming layer 62. According to one embodiment, primary layer comprises a primer such as 3-glycidoxypropyl) trimelhoxysilane 98% (ABCR, Germany), a silane based primer or adhesion promoter, a catalyst such as Stannous ocloat (Sigma) and a solvent such as Xylene (J T Baker). According to one embodiment, the catalyst solution or mixture which forms priming layer 64 is formed by dispersing a fumed silica (R972, Degussa) in the xylene using a sonieator. The solution is then mixed with the primer and the catalyst. This catalyst mixture has a working life for several hours. Primer layer 64 does not include any fillers having a particle size greater than 1μ. In one embodiment, primer layer 64 omits all fillers. As a result, blanket 46 is less subject to abrasion. In other embodiments, primary layer 64 may include other materials or compositions.

Release layer 50 comprises the outermost layer of blanket 46. Release layer 50 has a controlled bulk swelling capacity of less than or equal to about 145%. It has been found that this bulk swelling capacity impacts the performance of blanket 46. Because release layer 50 has a bulk swelling of less than or equal to about 145%, gloss memory is reduced. In addition, it has been found that with a bulk swelling capacity of less than 145%, the transfer of small dots from image transfer surface 28 to release layer 50 is enhanced.

According to one embodiment, release layer 50 also has a bulk swelling capacity of at least about 120%. Because release layer 50 has a bulk swelling capacity of at least about 120%, release layer 50 has sufficient releaseability for transfer efficiency. As a result, the transfer of imaging material from release layer 50 to print medium 21 (shown in FIG. 1) is enhanced. According to one embodiment, release layer 50 has a bulk swelling capacity of between about 130%; and about 145% for enhanced transfer performance.

For purposes of this disclosure and for purposes of interpreting the claims, the "bulk swelling capacity" of a film or layer, such as release layer 50, is determined according to the following test. A dry film have a thickness of between 1 to 3 mm is initially weighed to determine a dry weight of the film. The dry film is then immersed in isopar L in a sealed container. After 20 hours at 100 C, the film is cooled and is removed from the Isopar with excess solvent blotted with a clean dry cloth. The swollen film (swollen with isopar L) is weighed to determine its swollen weight. The bulk swelling capacity is defined by the following formula: (swollen weight−dry weight)/dry weight*100%.

According to one embodiment, release layer 50 is formed from a functional (Silanol) terminated silicone oil having a molecular weight of less than or equal to about 26,000 g per mole and greater than or equal to about 12,000 g per mole. The silicone oil comprises at least about 80% by weight of release layer 50. It has been found that the use of such a silicone oil results in a much more dense network in the release layer 50, reducing bulk swelling capacity. As noted above, because release layer 50 has a bulk swelling capacity of less than 145%, improvements in gloss memory and small dot-transfer from imaging surface 28 to release layer 50 are enhanced. At the same time, because the bulk swelling capacity is greater than 120%, the use of such a silicone oil as part of release layer 50 has sufficient releaseability for the transfer of imaging material to print medium 21.

According to one embodiment, release layer 50 comprises a room temperature vulcanizing (RTV) formulation including a functional silanol terminated polydimethylsiloxane, a cross-linker, a tin catalyst and a cure retarder. In particular, according to one embodiment, release layer 50 has the following formulation:

(1) DMS S-27 Polydimethylsiloxane silanol terminated 700-800 cSt, a silicone, 80-95% by wgt.;
(2) Carbon black, a filler, 0.1-5% by wgt;
(3) Oleic Acid, a cure retarder, 1-10%) by wgt.;
(4) Isopar L, a carrier liquid, 1-5% by wgt.;
(5) Methylsilicate 51, a cross linker, 0.5-10% by wgt.;
(6) Ethylsilicate 48, a cross linker, 0.5-10% by wgt.; and
(7) Dibutyltin dilaurate 95%, a catalyst, 0.1-5% by wgt.

According to one embodiment, release layer 50 is formed according to the following process. First, the Polydimethylsiloxane silanol terminated oil is mixed with carbon black using a high shear mixer. Second, the oleic acid is added to the mixture. Third, the cross-linkers and the catalyst are added and mixed. This resulting mixer, a "release solution" has a working life of several hours. This mixture is then coated onto the primer layer (64) which is itself coated onto the conforming layer 62.

Media transport 38 comprise a mechanism configured to transport and position a substrate or print medium 21 opposite to intermediate image transfer member 34 such that the imaging material may be transferred from member 34 to medium 21. In one embodiment, media transport 38 may comprise a series of one or more belts, rollers and a media guides. In another embodiment, media transport 38 may comprise a drum. In the example illustrated, media transport 38 is configured to pass print medium 21 a plurality of times across intermediate transfer member 34, wherein a separate individual layer of imaging material is transferred to print medium 21 during each successive pass of print medium 21 across transfer member 34. In one embodiment, print medium 21 comprises a sheet supported by a drum which rotates multiple times to pass print medium 21 across transfer member 34 multiple times.

Controller 39 comprises one or more processing units configured to generate control signals directing the operation of imaging liquid developer 24, imaging member 26, intermediate transfer member 34 and media transport 38. For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 39 may be embodied as part of one or more application-specific integrated circuits (ASICs). Unless otherwise specifically noted, the controller is not limited to any specific combination of hardware circuitry and software, nor to any particular source for the instructions executed by the processing unit.

In operation, controller 39 generates control signals directing imaging liquid developer 24 to apply a first layer of imaging liquid, including imaging material (colorant particles). As noted above, due to the electrostatic image or pattern formed upon imaging surface 28, an image of imaging material is formed on surface 28. This layer of imaging material is then transferred to intermediate image transfer member 34. Intermediate image transfer member 34 then transfers the layer of imaging material to print medium 21 during a single pass of print medium 21 by media transport 38. This process is repeated a plurality of times to stack layer upon layer of different imaging materials on print medium 21 to form the final image on print medium 21.

Because the final image is formed from multiple individual layers independently deposited upon print medium 21, such layers are extremely thin. As a result, transfer efficiency may have a large impact upon the quality of the final image. Because the final image is formed by multiple layers, gloss memory issues may be exacerbated. Release layer 50 of intermediate image transfer member 34 addresses such issues by reducing gloss memory and maintaining transfer efficiency for such a multi-shot printing process.

Figure 3:
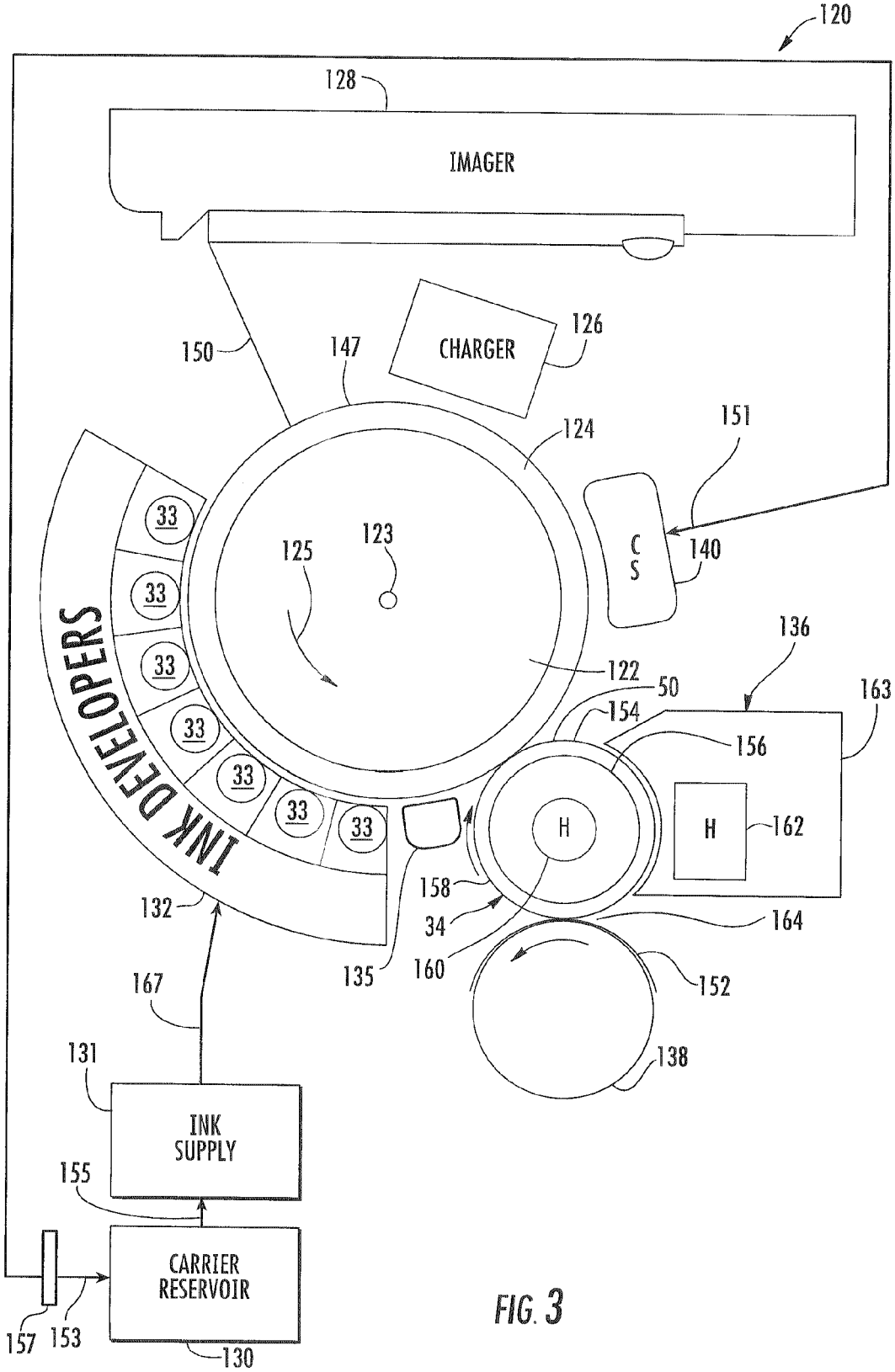
FIG. 3 is a schematic illustration of another embodiment of the imaging system of FIG. 1 according to an example embodiment.

FIG. 3 schematically illustrates printer 120, another embodiment of printer 20 shown in FIG. 1. Like printer 20, printer 120 utilizes intermediate transfer member 34 including release layer 50. Printer 120 comprises a liquid electrophotographic (LEP) printer. Printer 120, (sometimes embodied as part of an offset color press) includes drum 122, photoconductor 124, charger 126, imager 128, ink carrier oil reservoir 130, ink supply 131, developer 132, internally and/or externally heated intermediate transfer member 34, heating system 136, impression member 138 and cleaning station 140.

Drum 122 comprises a movable support structure supporting photoconductor 124. Drum 122 is configured to be rotationally driven about axis 123 in a direction indicated by arrow 125 by a motor and transmission (not shown). As a result, distinct surface portions of photoconductor 124 are transported between stations of printer 120 including charger 126, imager 128, ink developers 132, transfer member 34 and charger 134. In other embodiments, photoconductor 124 may be driven between substations in other manners. For example, photoconductor 124 may be provided as part of an endless belt supported by a plurality of rollers.

Photoconductor 124, also sometimes referred to as a photoreceptor, comprises a multi-layered structure configured to be charged and to have portions selectively discharged in response to optical radiation such that charged and discharged areas form a discharged image to which charged printing material is adhered.

Charger 126 comprises a device configured to electrostatically charge surface 147 of photoconductor 124. In one embodiment, charger 126 comprises a charge roller which is rotationally driven while in sufficient proximity to photoconductor 124 so as to transfer a negative static charge to surface 147 of photoconductor 124. In other embodiments, charger 126 may alternatively comprise one or more corotrons or scorotrons. In still other embodiments, other devices for electrostatically charging surface 147 of photoconductor 124 may be employed.

Imager 128 comprises a device configured to selectively electrostatically discharge surface 147 so as to form an image. In the example shown, imager 128 comprises a scanning laser which is moved across surface 147 as drum 122 and photoconductor 124 are rotated about axis 123. Those portions of surface 147 which are impinged by light or laser 150 are electrostatically discharged to form an image (or latent image) upon surface 147. In other embodiments, imager 128 may alternatively comprise other devices configured to selectively emit or selectively allow light to impinge upon surface 147. For example, in other embodiments, imager 128 may alternatively include one or more shutter devices which employ liquid crystal materials to selectively block light and to selectively allow light to pass to surface 147. In yet other embodiments, imager 128 may alternatively include shutters which include micro or nano light-blocking shutters which pivot, slide or otherwise physically move between a light blocking and light transmitting states.

Ink carrier reservoir 130 comprises a container or chamber configured to hold ink carrier oil for use by one or more components of printer 120. In the example illustrated, ink carrier reservoir 130 is configured to hold ink carrier oil for use by cleaning station 140 and ink supply 131. In one embodiment, as indicated by arrow 151, ink carrier reservoir 130 serves as a cleaning station reservoir by supplying ink carrier oil to cleaning station 140 which applies the ink carrier oil against photoconductor 124 to clean the photoconductor 124. In one embodiment, cleaning station 140 further cools the ink carrier oil and applies ink carrier oil to photoconductor 124 to cool surface 147 of photoconductor 124. For example, in one embodiment, cleaning station 140 may include a heat exchanger or cooling coils in ink care reservoir 130 to cool the ink carrier oil. In one embodiment, the ink carrier oil supply to cleaning station 140 further assists in diluting concentrations of other materials such as particles recovered from photoconductor 124 during cleaning.

After ink carrier oil has been applied to surface 147 to clean and/or cool surface 147, the surface 147 is wiped with an absorbent roller and/or scraper. The removed carrier oil is returned to ink carrier reservoir 130 as indicated by arrow 153. In one embodiment, the ink carrier oil returning to ink carrier reservoir 130 may pass through one or more filters 157 (schematically illustrated). As indicated by arrow 155, ink carrier oil in reservoir 130 is further supplied to ink supply 131. In other embodiments, ink carrier reservoir 130 may alternatively operate independently of cleaning station 140, wherein ink carrier reservoir 130 just supplies ink carrier oil to ink supply 131.

Ink supply 131 comprises a source of printing material for ink developers 132. Ink supply 131 receives ink carrier oil from carrier reservoir 130. As noted above, the ink carrier oil supplied by ink carrier reservoir 130 may comprise new ink earner oil supplied by a user, recycled ink carrier oil or a mixture of new and recycling carrier oil. Ink supply 131 mixes being carrier oil received from ink carrier reservoir 130 with pigments or other colorant particles. The mixture is applied to ink developers 132 as needed by ink developers 132 using one or more sensors and solenoid actuated valves (not shown).

In the particular example shown, the raw, virgin or unused printing material may comprise a liquid or fluid ink comprising a liquid carrier and colorant particles. The colorant particles have a size of less than 2μ. In different embodiments, the particle sizes may be different. In the example illustrated, the printing material generally includes approximately 3% by weight, colorant particles or solids part to being applied to surface 147. In one embodiment, the colorant particles include a toner binder resin comprising hot melt adhesive.

In one embodiment, the liquid carrier comprises an ink carrier oil, such as Isopar, and one or more additional components such as a high molecular weight oil, such as mineral oil, a lubricating oil and a defoamer. In one embodiment, the printing material, including the liquid carrier and the colorant particles, comprises HEWLETT-PACKARD ELECTRO INK commercially available from Hewlett-Packard.

Ink developers 132 comprises devices configured to apply printing material to surface 147 based upon the electrostatic charge upon surface 147 and to develop the image upon surface 147. According to one embodiment, ink developers 132 comprise binary ink developers (BIDs) circumferentially located about drum 122 and photoconductor 124. Such ink developers are configured to form a substantially uniform 6μ thick electrostatically charged layer composed of approximately 20% solids which is transferred to surface 147. In yet other embodiments, ink developers 132 may comprise other devices configured to transfer electrostatically charged liquid printing material or toner to surface 147.

Intermediate image transfer member 34 comprises a member configured to transfer the printing material upon surface 147 to a print medium 152 (schematically shown). Intermediate transfer member 34 includes an exterior surface 154 which is resiliency compressible and which is also configured to be electrostatically charged. Because surface 154 is resiliency compressible, surface 154 conforms and adapts to irregularities in print medium 152. Because surface 154 is configured to be electrostatically charged, surface 154 may be charged so as to facilitate transfer of printing material from surface 147 to surface 154.

As noted above with respect to imaging system 20, release layer 50 (shown in FIG. 2) of intermediate image transfer member 34 has a controlled bulk swelling capacity of less than or equal to about 145%. It has been found that this bulk swelling capacity impacts the performance of blanket 46 (shown in FIG. 2). Because release layer 50 has a bulk swelling of less than or equal to about 145%, gloss memory is reduced. In addition, it has been found that with a bulk swelling capacity of less than 145%, the transfer of small dots from image transfer surface 147 to release layer 50 is enhanced.

According to one embodiment, release layer 50 also has a bulk swelling capacity of at least about 120%. Because release layer 50 has a bulk swelling capacity of at least about 120%, release layer 50 has sufficient releaseability for transfer efficiency. As a result, the transfer of imaging material from release layer 50 to print medium 152 is enhanced. According to one embodiment, release layer 50 has a bulk swelling capacity of between about 130% and about 145% for enhanced transfer performance.

According to one embodiment, release layer 50 is formed from a functional silanol terminated polydimethylsiloxane having a molecular weight of less than or equal to about 26,000 g per mole and greater than or equal to about 12,000 g per mole. The silicone oil comprises at least about 80% by weight of release layer 50. It has been found that the use of such a silicone oil results in a much more dense network in the release layer 50, reducing bulk swelling capacity. As noted above, because release layer 50 has a bulk swelling capacity of less than 145%, improvements in gloss memory and small clot transfer from imaging surface 147 to release layer 50 are enhanced. At the same time, because the bulk swelling capacity is greater than 120%, the use of such a silicone oil as part of release layer 50 has sufficient releaseability for the transfer of imaging material to print medium 152.

Heating system 136 comprises one or more devices configured to apply heat to printing material being carried by surface 154 from photoconductor 124 to medium 152. In the example illustrated, heating system 136 includes internal heater 160, external heater 162 and vapor collection plenum 163. Internal heater 160 comprises a heating device located within drum 156 that is configured to emit heat or inductively generate heat which is transmitted to surface 154 to heat and dry the printing material carried at surface 154. External heater 162 comprises one or more heating units located about transfer member 34. According to one embodiment, healers 160 and 162 may comprise infrared heaters.

Heaters 160 and 162 are configured to heat printing material to a temperature of at least 85° C. and less than or equal to about 110° C. In still other embodiments, heaters 160 and 162 may have other configurations and may heat printing material upon transfer member 34 to other temperatures. In particular embodiments, heating system 136 may alternatively include one of either internal heater 160 or external heater 162.

Vapor collection plenum 163 comprises a housing, chamber, duct, vent, plenum or other structure at least partially circumscribing intermediate transfer member 34 so as to collect or direct ink or printing material vapors resulting from the healing of the printing material on transfer member 34 to a condenser (not shown).

Impression member 138 comprises a cylinder adjacent to intermediate transfer member 34 so as to form a nip 164 between member 34 and member 138. Medium 152 is generally fed between transfer member 34 and impression member 138, wherein the printing material is transferred from transfer member 34 to medium 152 at nip 164. Although impression member 138 is illustrated as a cylinder or roller, impression member 138 and alternatively comprise an endless belt or a stationary surface against which intermediate transfer member 34 moves.

Cleaning station 140 comprises one or more devices configured to remove any residual printing material from photoconductor 124 prior to surface areas of photoconductor 124 being once again charged at charger 126. In one embodiment, cleaning station 140 may comprise one or more devices configured to apply a cleaning fluid to surface 147, wherein residual toner particles are removed by one or more is absorbent rollers. In one embodiment, cleaning station 140 may additionally include one or more scraper blades. In yet other embodiments, other devices may be utilized to remove residual toner and electrostatic charge from surface 147.

In operation, ink developers 132 develop an image upon surface 147 by applying electrostatically charged ink having a negative charge. Once the image upon surface 147 is developed, charge eraser 135, comprising one or more light emitting diodes, discharges any remaining electrical charge upon such portions of surface 147 and ink image is transferred to surface 154 of intermediate transfer member 34. In the example shown, the printing material formed comprises and approximately 1.0μ thick layer of approximately 90% solids color or particles upon intermediate transfer member 34.

Heating system 136 applies heat to such printing material upon surface 154 so as to evaporate the carrier liquid of the printing material and to melt toner binder resin of the color and particles or solids of the printing material to form a hot melt adhesive. Thereafter, the layer of hot colorant particles forming an image upon surface 154 is transferred to medium 152 passing between transfer member 34 and impression member 138. In the embodiment shown, the hot colorant particles are transferred to print medium 152 at approximately 90° C. The layer of hot colorant particles cool upon contacting medium 152 on contact in nip 164.

These operations are repeated for the various colors for preparation of the final image to be produced upon medium 152. As a result, one color separation at a time is formed on a surface 154. This process is sometimes referred to as "multi-shot" process.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising:

at least a portion of a blanket for an intermediate transfer member (ITM) operative for transfer of a toner image from an image bearing surface for a subsequent transfer to a substrate; the portion of the blanket comprising:

a supportive portion; and a release layer facing outwardly from and supported by the supportive portion, the release layer having a bulk swelling capacity of less than or equal to about 145% in Isopar L, wherein the release layer has a bulk swelling capacity of greater than or equal to about 120% in Isopar L.

2. The apparatus of claim 1, where the release layer has a bulk swelling capacity of between about 130% and about 145% in Isopar L.

3. The apparatus of claim 1, wherein a raw material of the release layer comprises a functional silanol terminated silicone oil having a molecular weight of less than or equal to about 26,000 g/mole.

4. The apparatus of claim 3, wherein a raw material of the release layer comprises a functional silanol terminated silicone oil having a molecular weight of greater than or equal to about 12,000 g/mole.

5. The apparatus of claim 3, wherein the release layer comprises a functional silanol terminated silicone oil having a preferred molecular weight about 18,000 g/mole.

6. The apparatus of claim 3, wherein the functional terminated silicone oil comprises at least about 80% by weight of the release layer.

7. The apparatus of claim 1 further comprising:

an imaging drum configured to transfer liquid toner to the release layer;

a media transport configured to present a print medium opposite to the release layer; and a controller configured to generate control signals causing the imaging drum to deposit layers of liquid toner having different colors on the release layer, wherein after each individual layer is deposited on the release layer, the release layer deposits the individual layer on the print medium or on top of any existing layer on the print medium prior to receiving another one of the layers of liquid toner.

8. A method comprising:

transferring a plurality of layers of different colors of liquid toner onto a release layer of an intermediate transfer medium having bulk swelling between 120% and 145% in Isopar L; and after each individual layer is deposited on the release layer, transferring the individual layer from the release layer onto the print medium or on top of any existing layer on the print medium prior to the release layer receiving another one of the layers of liquid toner.

9. The method of claim 8, wherein a raw material of the release layer comprises a functional terminated silicone oil having a molecular weight of less than or equal to about 26,000 g/mole.

10. An intermediate transfer member blanket comprising:

a supportive portion; and a release layer facing outwardly from and supported by the supportive portion, the release layer having raw ingredients prior to cross-linking comprising:

a cross linker; and a functional silanol terminated silicone oil having a molecular weight of less than or equal to about 26,000 g/mole, wherein the release layer has a bulk swelling capacity of greater than or equal to about 120% in Isopar L.

11. The intermediate transfer member blanket of claim 10, wherein the release layer has a bulk swelling capacity of between about 130% and about 145% in Isopar L.

12. The intermediate transfer member blanket of claim 10, wherein the release layer has a bulk swelling capacity of at least 130% in Isopar L.

13. The intermediate transfer member blanket of claim 10, wherein the only functional silanol terminated silicone oil in the release layer are methylsilicone formulations.

14. The intermediate transfer member blanket of claim 13, wherein the release layer has a bulk swelling capacity of at least 130% in Isopar L.

15. The intermediate transfer member blanket of claim 14, wherein the functional silanol terminated silicone oil in the release layer comprises at least 80% by weight of the release layer.

16. An apparatus comprising:

at least a portion of a blanket for an intermediate transfer member (ITM) operative for transfer of a toner image from an image bearing surface for a subsequent transfer to a substrate; the portion of the blanket comprising:

a supportive portion; and a release layer facing outwardly from and supported by the supportive portion, the release layer having a bulk swelling capacity of less than or equal to about 145% in Isopar L;

an imaging drum configured to transfer liquid toner to the release layer;

a media transport configured to present a print medium opposite to the release layer; and a controller configured to generate control signals causing the imaging drum to deposit layers of liquid toner having different colors on the release layer, wherein after each individual layer is deposited on the release layer, the release layer deposits the individual layer on the print medium or on top of any existing layer on the print medium prior to receiving another one of the layers of liquid toner.

17. The apparatus of claim 16, wherein the release layer has a bulk swelling capacity of greater than or equal to about 120% in Isopar L.

18. The apparatus of claim 16, where the release layer has a bulk swelling capacity of between about 130% and about 145% in Isopar L.

19. The apparatus of claim 16, wherein a raw material of the release layer comprises a functional silanol terminated silicone oil having a molecular weight of less than or equal to about 26,000 g/mole.

20. The apparatus of claim 19, wherein a raw material of the release layer comprises a functional silanol terminated silicone oil having a molecular weight of greater than or equal to about 12,000 g/mole.

21. The apparatus of claim 19, wherein the release layer comprises a functional silanol terminated silicone oil having a preferred molecular weight about 18,000 g/mole.

22. The apparatus of claim 19, wherein the functional terminated silicone oil comprises at least about 80% by weight of the release layer.

* * * * *